US006659935B2

(12) United States Patent
Costanzo

(10) Patent No.: US 6,659,935 B2
(45) Date of Patent: Dec. 9, 2003

(54) LIFTING APPARATUS FOR PATIENT SUPPORT SURFACE

(75) Inventor: Joseph A. Costanzo, Federal Way, WA (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/955,850

(22) Filed: Sep. 19, 2001

(65) Prior Publication Data

US 2002/0077525 A1 Jun. 20, 2002

Related U.S. Application Data

(60) Provisional application No. 60/234,443, filed on Sep. 21, 2000.

(51) Int. Cl.[7] ..... A61G 11/00; A47B 7/00

(52) U.S. Cl. ..... 600/22; 5/610; 5/611

(58) Field of Search ..... 600/22; 119/28.5, 119/727; 5/611, 616, 81.1 R, 87.1, 624, 614, 618, 610, 86.1, 617, 613; 414/495, 347, 498, 537, 809; 128/205.26; 601/26, 5; 378/209

(56) References Cited

U.S. PATENT DOCUMENTS

| | | | | |
|---|---|---|---|---|
| 2,187,312 A | | 1/1940 | Goodlake | |
| 3,158,150 A | | 11/1964 | Croasdaile | |
| 3,187,744 A | | 6/1965 | Dorsak et al. | |
| 3,335,713 A | | 8/1967 | Grosholz et al. | |
| 3,798,684 A | * | 3/1974 | Benoit et al. | 5/614 |
| 3,821,947 A | | 7/1974 | Schossow | |
| 3,858,570 A | | 1/1975 | Beld et al. | |
| 4,087,872 A | * | 5/1978 | Smirle | 5/611 |
| 4,161,172 A | | 7/1979 | Pickering | |
| 4,175,550 A | * | 11/1979 | Leininger et al. | 601/5 |
| 4,190,913 A | * | 3/1980 | DiMatteo et al. | 5/83.1 |
| 4,221,211 A | * | 9/1980 | Brasch | 600/22 |
| 4,222,602 A | | 9/1980 | Kouth | |

(List continued on next page.)

FOREIGN PATENT DOCUMENTS

| | | |
|---|---|---|
| DE | 2061704 | 6/1971 |
| EP | 0 541 981 | 5/1993 |
| EP | 0 743 054 | 11/1996 |
| EP | 0 968 698 | 1/2000 |
| GB | 1 232 048 A | 5/1971 |
| JP | 49-122184 | 11/1974 |
| WO | WO 97/11664 | 4/1997 |
| WO | 99/12510 | 3/1999 |
| WO | 01/43686 | 6/2001 |

OTHER PUBLICATIONS

"Stabilet® from Hill–Rom®" Product Brochure, six pages, (1992).

"Stabilet CC™ from Hill–Rom®" Product Brochure, six pages, (1992).

"The Stabilet™ Freestanding Warmer and Clinical Bassinet From Hill–Rom®", Product Brochure, four pages, (1993).

"A Hill–Rom Solution, Stabilet 2000C, Stabilet CC, Stabilet Freestanding Infant Warmer Accessories", Product Brochure, eight pages, (1995).

"Isolette® Infant Incubator", *Air Shields, Inc.* Product Brochure, eight pages, (1996).

*Primary Examiner*—Eric F. Winakur
*Assistant Examiner*—Nikita R Veniaminov
(74) *Attorney, Agent, or Firm*—Barnes & Thornburg

(57) ABSTRACT

An infant support for use with an incubator or a warmer or a combination thereof comprises a support surface having a head end and a foot end and a driver engageable with the head and foot ends. The driver comprises a first elevator and a second elevator. The first elevator is engageable with the head end and the second elevator is engageable with the foot end. The driver is movable to cause the head and foot ends to move between raised and lowered positions.

17 Claims, 13 Drawing Sheets

U.S. PATENT DOCUMENTS 4,236,261 A * 12/1980 Huempfner ..... 5/616
4,361,137 A 11/1982 Grosholz
4,472,845 A * 9/1984 Chivetta et al. ..... 5/611
4,501,414 A * 2/1985 Mason et al. ..... 5/614
4,552,034 A 11/1985 Bertani et al.
4,617,912 A 10/1986 Beer et al.
4,628,553 A 12/1986 Buttitta et al.
4,734,945 A 4/1988 Wright
4,750,474 A 6/1988 Dukhan et al.
4,809,677 A 3/1989 Mackin et al.
4,819,282 A 4/1989 McArthur et al.
4,885,918 A 12/1989 Vaccaro
5,018,931 A * 5/1991 Uttley ..... 414/495
5,090,072 A * 2/1992 Gray ..... 5/87.1
5,162,038 A 11/1992 Wilker
5,205,004 A * 4/1993 Hayes et al. ..... 5/611
5,244,452 A 9/1993 Vaccaro et al.
5,308,310 A 5/1994 Roff et al.
5,376,761 A 12/1994 Koch et al.
5,453,077 A 9/1995 Donnelly et al.
5,474,517 A 12/1995 Falk et al.
5,498,229 A 3/1996 Barsky et al.
5,531,663 A 7/1996 Gloyd et al.
5,624,375 A 4/1997 Dykes et al.
5,830,123 A 11/1998 Franz et al.
5,906,017 A * 5/1999 Ferrand et al. ..... 5/617
6,022,310 A 2/2000 Goldberg et al.
6,071,228 A 6/2000 Speraw et al.
6,199,508 B1 * 3/2001 Miale et al. ..... 119/28.5
6,353,949 B1 * 3/2002 Falbo ..... 5/610

* cited by examiner

GEAR BOX 88
70
250
314
266
381
384
306
270
274
90
72
288
308
302
264
304
382
284
308
268
380
272
276
286
256
282
296
F
F
322
260
320
72
6
262
6
385
386
322

LIFTING APPARATUS FOR PATIENT SUPPORT SURFACE

This application claims priority under 35 U.S.C. §119(e) to U.S. Provisional Application Serial No. 60/234,443, filed Sep. 21, 2000, which is expressly incorporated by reference herein.

TECHNICAL FIELD

The application relates to infant incubators and warmers, and more particularly, to the provision of a lifting mechanism for the patient support surface of an incubator and warmer. In this application, the lifting mechanism will be described as used in an incubator, but it will be appreciated that the mechanism will be useful in an incubator, a warmer, or combination incubator and warmer.

BACKGROUND AND SUMMARY

An incubator provides a generally transparent enclosure within which heated air is circulated to minimize the heat loss of an infant. The infant typically lies on a mattress supported by a deck or support surface inside the incubator. Such incubators are typically provided with a large access door to allow for placement or removal of the infant in the incubator, as well as supplemental access ways such as hand ports or small entry doors to permit routine care of the infant while minimizing heat loss from the incubator and the infant.

To provide appropriate care to the infant the caregiver may need to move the infant relative to the incubator. Conventional support surfaces are configured to raise and lower relative to the incubator, giving the caregiver a more convenient work environment inside the incubator. Commonly referred to as trendelenberg and reverse-trendelenberg positions, the support surfaces of conventional incubators are often configured to tilt at both the head and foot ends.

Conventional incubators include independent lifting mechanisms to raise and lower either end of the support surface. This requires the caregiver to engage a first mechanism to tilt one end, then lower that mechanism and then raise a second mechanism to tilt the other end. For example, the caregiver will either manually turn a first hand crank or knob, or engage a first motor, that engages the first lifting mechanism for lifting one end of the surface. If the caregiver wishes to tilt the other end, he/she will first have to lower the first lifting mechanism. This requires the caregiver to either reverse turn the hand crank or knob, or reverse engage the first motor to lower the raised end. Once the raised end is lowered, the caregiver will then have to either manually turn a second hand crank or knob, or engage a second motor, that engages a second lifting mechanism for lifting the other end of the surface. These several motions made by the caregiver take a substantial amount of time and effort to accomplish, thereby, reducing response time and efficiency in moving the patient when needed.

It would be desirable, therefore, to provide an infant support surface for an incubator or warmer that includes a mechanism for raising or lowering or tilting or reverse tilting the support surface, which system requires only a single action or reverse action by the caregiver. For example, it would be desirable for the caregiver to have to turn only one hand crank or knob to tilt one end of the surface, and then simply reverse turn the crank or knob to tilt the other end of the surface. It would be advantageous to provide a motor drive arrangement which can be controlled by operating a switch assembly with one hand.

According to an illustrative embodiment of the present disclosure, an infant support for an incubator or a warmer or a combination thereof comprises a support surface for receiving an infant, the support surface having a head end and a foot end, an elevator coupled to each end of the support surface to raise and lower each end, and a drive associated with the elevators. The drive comprises a motor coupled to each elevator and a control for the motors, whereby either end of the support surface may be moved between raised and lowered positions. Each motor is, for example, a stepper motor and is coupled to the associated elevator by a rack and pinion gear unit. A switch is coupled to the control to raise and lower the support surface and tilt the support surface between trendelenberg and reverse-trendelenberg positions.

In another illustrative embodiment, the infant support comprises a head end lifting mechanism for the head end, a foot end lifting mechanism for the foot end, and a driver coupled to the head end lifting mechanism and the foot end lifting mechanism. The driver includes a rotatable drive screw, a bracket coupled to the drive screw for movement along the drive screw, and a line, such as a chain or a cable, coupled to the bracket for movement therewith. Each lifting mechanism comprises idlers in the form of sprockets or pulleys, for example. The line extends past the idlers to couple to an elevator of each lifting mechanism. A bias member, such as a spring, is coupled to one of the idlers to take up slack in the chain during raising or lowering or tilting of the support surface between trendelenberg and reverse-trendelenberg positions.

A caregiver can raise the head end while the foot end remains lowered by causing the bracket to move away from the head end lifting mechanism. Similarly, a caregiver can raise the foot end while the foot end remains lowered by causing the bracket to move away from the foot end lifting mechanism.

In yet another embodiment, the infant support has a support surface, opposing first and second elevators, a driver and first and second drive plate mechanisms. The opposing first and second elevators are movable between raised and lowered positions. The driver is coupled to the support for movement in first and second directions. The first and second drive plate mechanisms are each coupled to the driver. The first drive plate mechanism is configured to move the first elevator to the raised position when the driver is moved in the first direction. The second drive plate mechanism is configured to move the second elevator to the raised position when the driver is moved in the second direction.

In yet another embodiment, the infant support has a support surface lifting apparatus for moving an infant between trendelenberg and reverse trendelenberg positions. The apparatus comprises a support surface, a driver, a pivot member and an actuator. The support surface for supporting the infant is movable relative to the incubator. The pivot member comprises a pair of angularly extending arms pivotally attached to the incubator at the vertex of the arms. The pivot member is also movably coupled to the driver such that each of the arms is engageable with the support surface. The actuator is coupled to the driver to move the arms to engage the support surface for moving each end of the support surface between raised, lowered and level positions.

Additional features and advantages of the application will become apparent to those skilled in the art upon consideration of the following descriptions.

BRIEF DESCRIPTION OF THE DRAWINGS

The present application will be described hereinafter with reference to the attached drawings which are given as non-limiting examples only, in which.

Corresponding reference characters indicate corresponding parts throughout the several views. The exemplification set out herein illustrates the embodiment of the application, in several forms, and such exemplification is not to be construed as limiting the scope of the application in any manner.

DETAILED DESCRIPTION OF THE DRAWINGS

Figure 1:
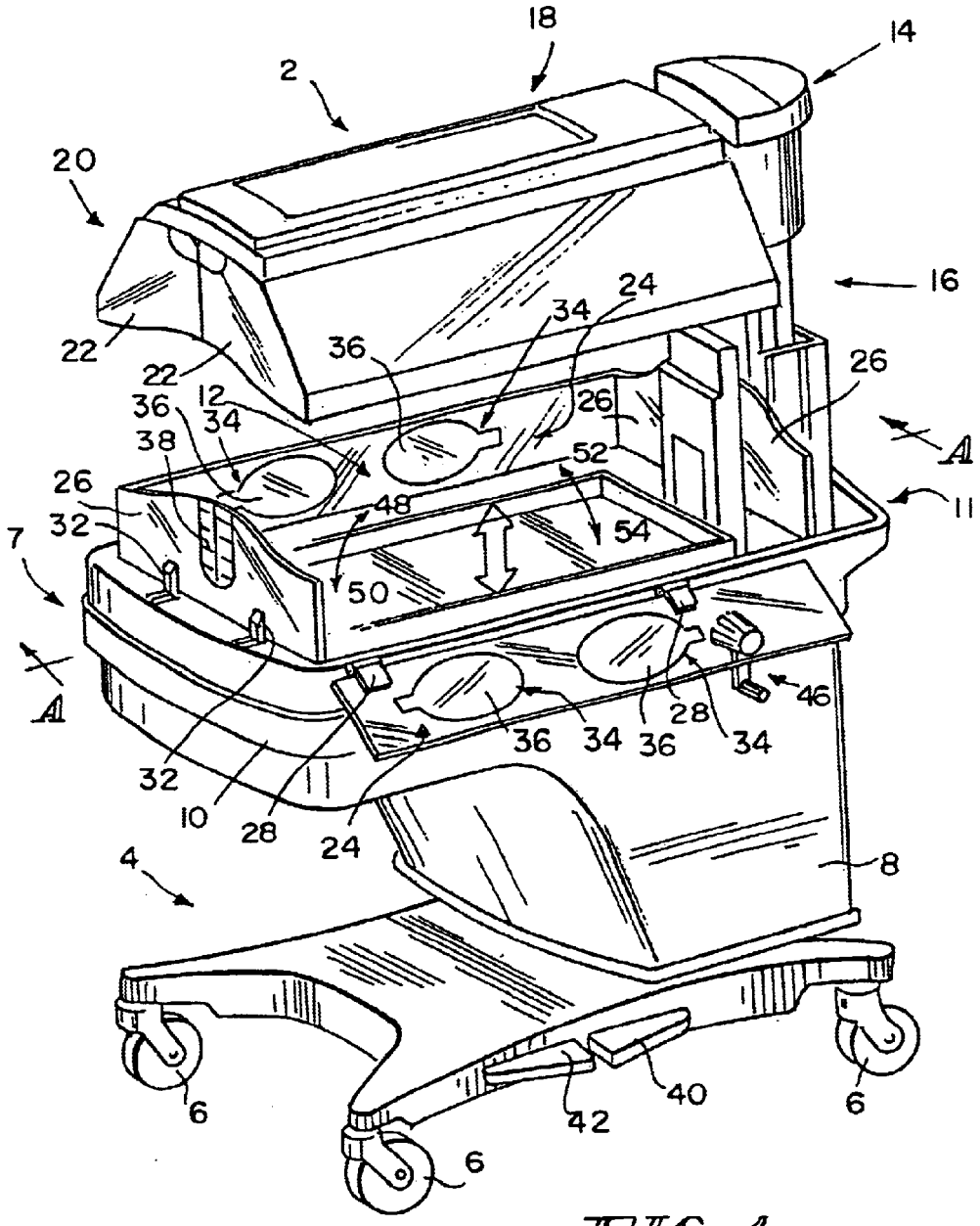
FIG. 1 is a perspective view of a patient support apparatus.

An infant-support apparatus 2, such as an infant warming device or incubator, includes a base 4, a plurality of castors 6 extending downwardly from base 4, and an infant supporting portion or patient support 7 supported above base 4 as shown in FIG. 1. Patient support 7 includes a pedestal 8 coupled to base 4 for vertical movement, a platform tub 10 supported by pedestal 8, and a support surface 12 positioned above platform tub 10. Platform tub 10 is formed to include a handle 11 on each side of canopy support arm 14. Handles 11 can be grasped by a caregiver to maneuver infant-support apparatus 2 during transport.

Infant-support apparatus 2 also includes a canopy support arm 14 comprising a telescoping vertical arm 16 and a horizontal overhead arm 18. A canopy 20 is coupled to overhead arm 18 and is positioned to lie above platform tub 10. Canopy 20 includes a pair of canopy halves 22 coupled to overhead arm 18 for pivoting movement between a lowered position (as shown) and a raised position (not shown). Up and down buttons (not shown) can be pressed to extend and retract vertical arm 16 of canopy support arm 14, thereby raising and lowering overhead arm 18 and canopy 20 with respect to tub 10.

A pair of transparent side guard panels 24 and a pair of transparent end guard panels 26 extend upwardly from platform tub 10, as shown in FIG. 1. Side and end guard panels 24, 26 cooperate with canopy halves 22 and overhead arm 18 to provide an isolation chamber. Panels 24 include hinges 28 that are also attached to platform tub 10 allowing a caregiver to pivot panels 24 downwardly away from canopy 20 providing increased access to the infant on support surface 12. End guard panels 26 also include hinges 32 which also pivot downwardly for further access to the infant on support surface 12.

A pair of access ports 34 are provided on side guard panels 24. Ports 34 are normally closed by access port covers 36. Access port covers 36 can be removed to allow access to the infant on support surface 12 while isolated in infant-support apparatus 2.

At least one end guard panel 26 is formed to include at least one pass-through grommet 38. Wires and tubes (not shown) can be routed into the isolation chamber through pass-through grommets 38.

Infant-support apparatus 2 further includes an "up" pedal 40 that is depressed to raise patient support 7 relative to base 4 and a "down" pedal 42 that is depressed to lower patient support 7 relative to base 4. A crank handle 46 is shown extending from platform tub 10. By rotating crank handle 46 in a particular direction surface 12 will tilt or reverse tilt (also known as trendelenberg and reverse trendelenberg), as shown by directional arrows 48, 50, 52, and 54.

Other features of infant-support apparatus 2 are discussed in detail in U.S. Pat. No. 6,022,310, titled "Canopy Adjustment Mechanisms for Thermal Support Apparatus," which is incorporated herein by reference.

Figure 2:
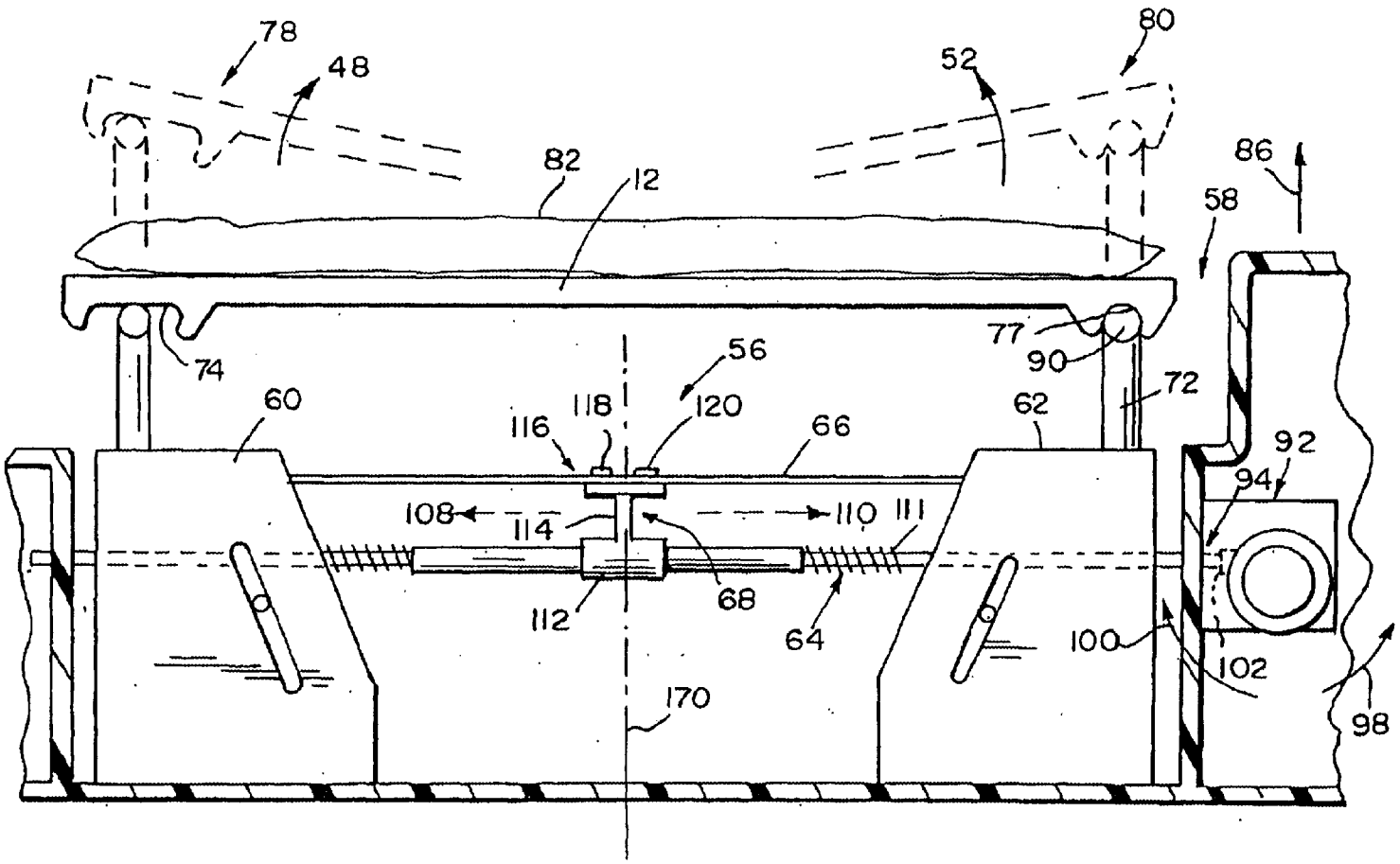
FIG. 2 is a side cross-sectional view of the patient support apparatus of FIG. 1 along the lines A—A of FIG. 1 showing the lifting apparatus.

In the illustrated embodiment, lifting apparatus 56, shown in FIG. 2, is positioned in well 58 of tub 10. Lifting apparatus 56 comprises a pair of lifting mechanism housings 60, 62, a threaded drive shaft 64, a chain 66, and a bracket 68. Lift bars 70, 72 extend from lifting mechanism housings 60, 62, respectively, engaging couplings 74, 77 to lift support surface 12 in either direction 48 or 52. As depicted by broken outlines 78, 80, as each lift bar 70, 72, raises in respective direction 84, 86, support surface 12 and mattress 82 will tilt in respective directions 48, 52.

Each lift bar 70, 72 includes a rounded head bar 88, 90. (See also FIG. 7.) Head bars 88, 90 engage couplings 74, 77, respectively. Coupling 74 is formed to includes an elongated space to allow head 88 to travel in the space when support surface 12 is raised or lowered. As depicted in FIG. 2, a comparison of the position of head 88, while support surface 12 is in the generally horizontal position, with its position in the broken outline 78, shows the distance bar 88 moves relative to coupling 74 to compensate for the movement of surface 12.

Coupling 77 receives head bar 90. Coupling 77 is configured similar to a socket within which head bar 90 pivots, as support surface 12 moves upwardly to position 52, as depicted by broken outline 80. It is appreciated that, as lift bar 72 moves upwardly, the longitudinal shifting of surface 12 is compensated for by movement of head bar 88 within coupling 74, as previously discussed.

Figure 7:
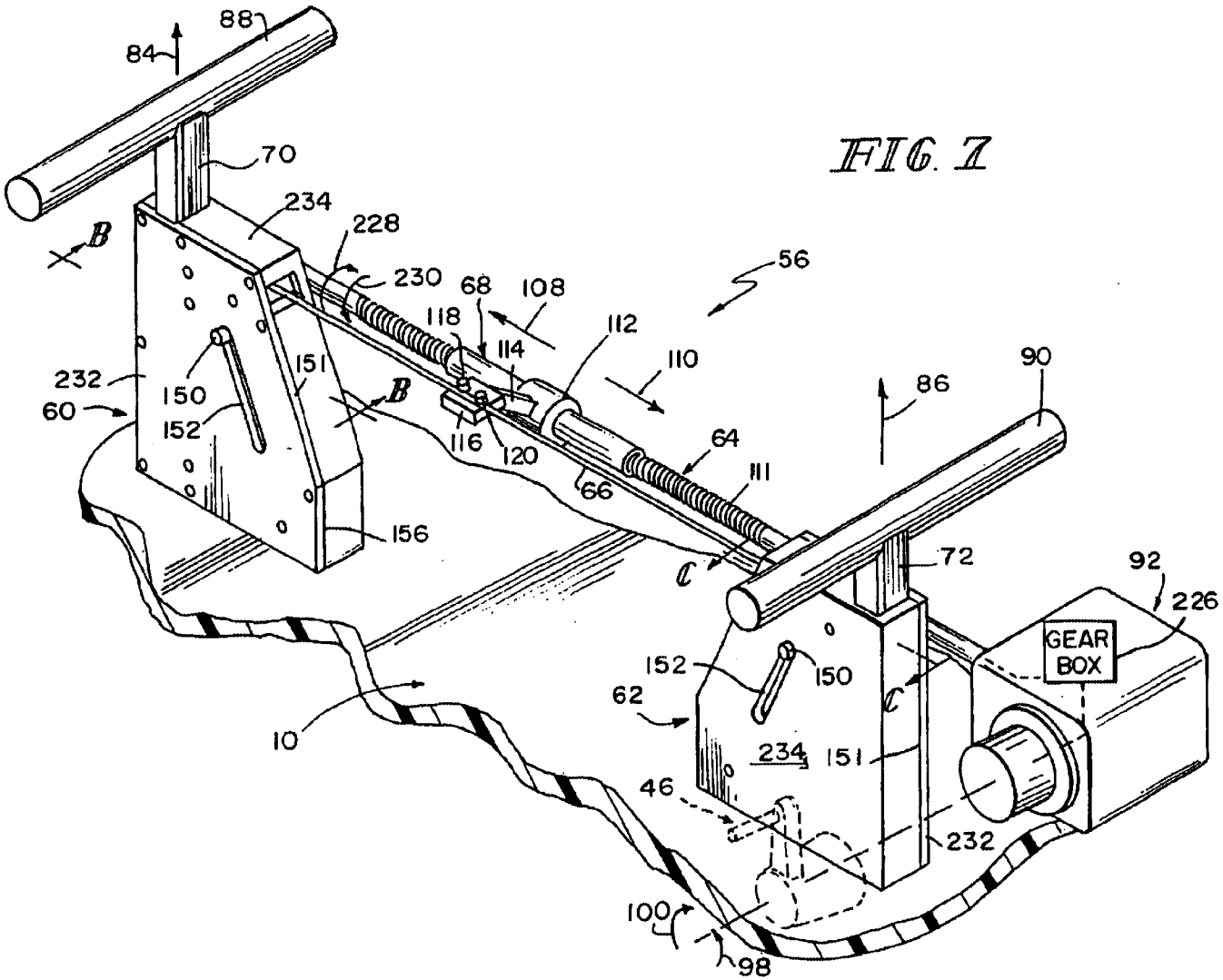
FIG. 7 is a perspective view of the lifting apparatus of FIG. 2.

An actuator assembly 92 is positioned adjacent wall 94 of well 58. Actuator assembly 92 is configured to bi-directionally rotate drive shaft 64. Gears (not shown) or some other mechanism can be used to translate motion from the actuator assembly 92 to drive shaft 64. Such power can be a motor, or as shown in FIGS. 1 and 7 it can be crank handle 46. When the caregiver turns handle 46 in one direction 98, for example, drive shaft 64 will be caused to move in one direction. When turning handle 46 in the opposite direction 100, drive shaft 64 will be caused to move in the opposite direction. In the illustrated embodiment, the first end 102 of drive shaft 64 is disposed through wall 94 and is coupled with actuator assembly 92. Similarly, second end 104 of drive shaft 64 is disposed through wall 106 of well 58. Wall 106 can act as the bearing within which end 104 rotates or can act as a bearing mount for such a bearing.

As drive screw 64 is rotated, bracket 68 is caused to move selectively in either direction 108 or 110. In the illustrated embodiment, drive screw 64 includes threads 111 and screw mount portion 112 has an aperture disposed therethrough having corresponding threads (not shown) to mate with threads 111. Accordingly, as drive shaft rotates in a longitudinally fixed position, the mating threads of drive shaft 64 and screw mount portion 112 move bracket 68 along the length of drive shaft 64. A space bar 114 is appended to screw mount portion 112 at one end and nut assembly 116 at the other end. Nut assembly 116 is configured to attach to chain 66. Nuts 118, 120 engage chain 66 and fasten to assembly 116. Therefore, as assembly 68 travels in either direction 108, 110, chain 66 is caused to move therewith.

Figure 3:
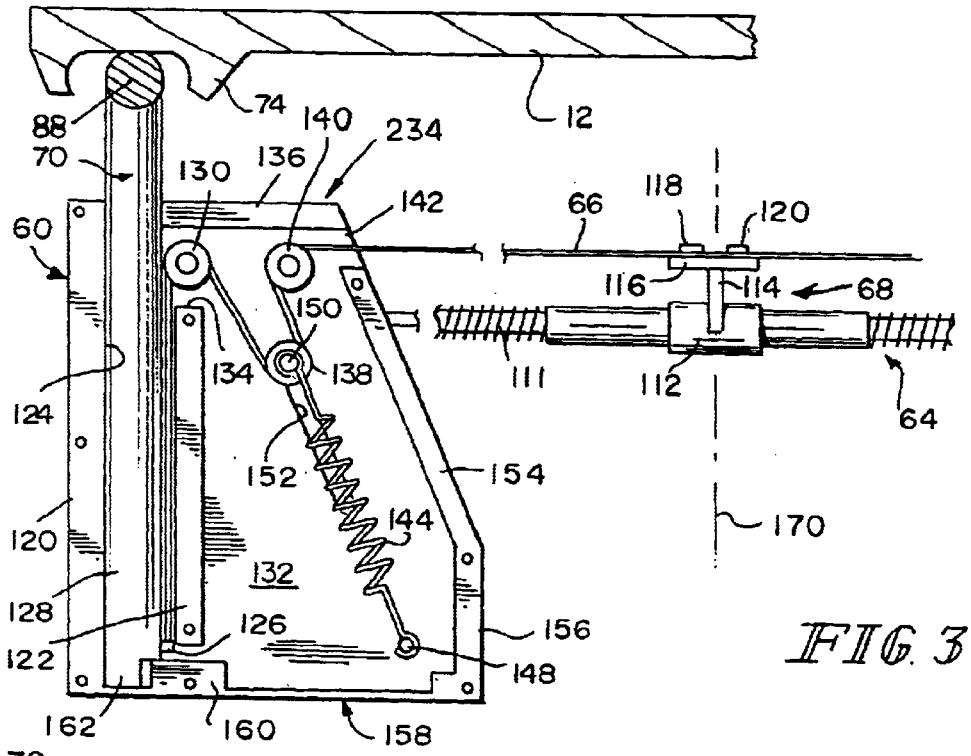
FIG. 3 is a cross-sectional view of one of the lifting mechanisms taken along the lines B—B of FIG. 7 with the lifting bar of the lifting mechanism in the lowered position when a bracket coupled to a chain of the lifting apparatus is positioned at a mid-line.
Figure 4A:
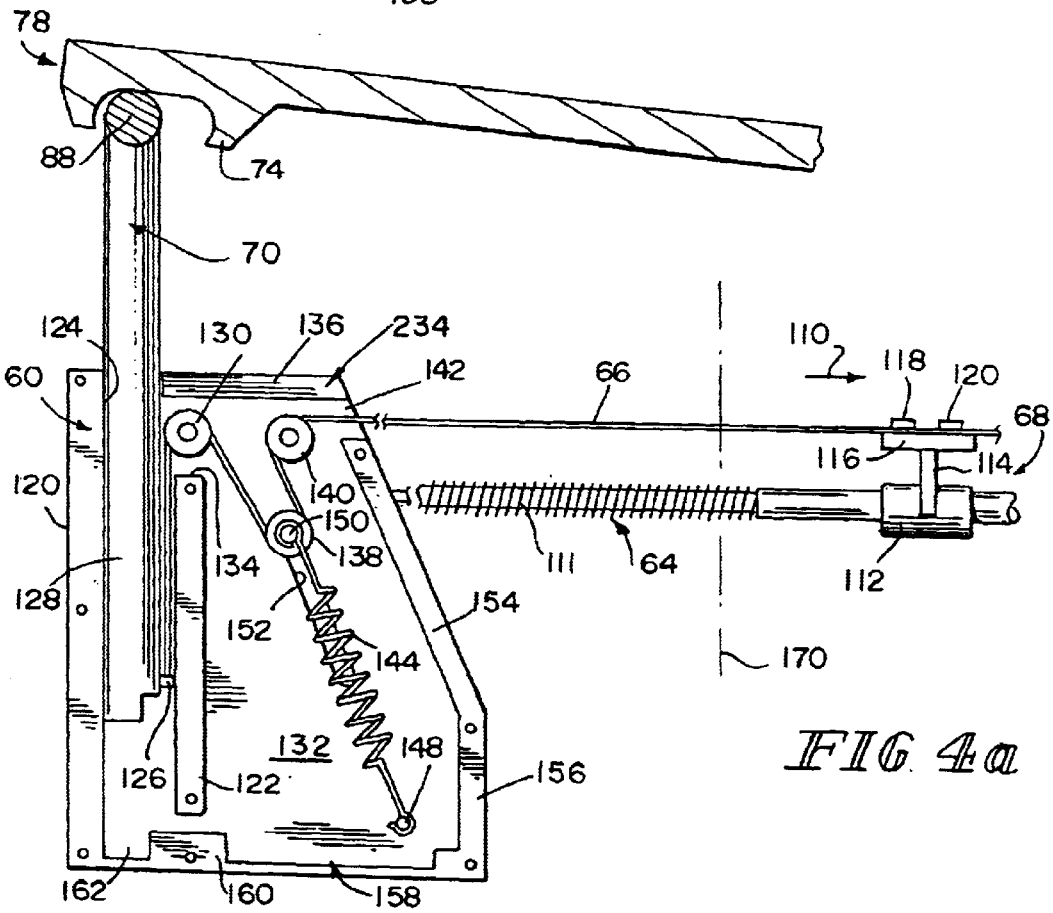
FIG. 4*a* is a cross-sectional view of the lifting mechanism of FIG. 3 showing its lifting bar in the raised position when the bracket is moved away from the lifting mechanism and the mid-line.
Figure 6B:
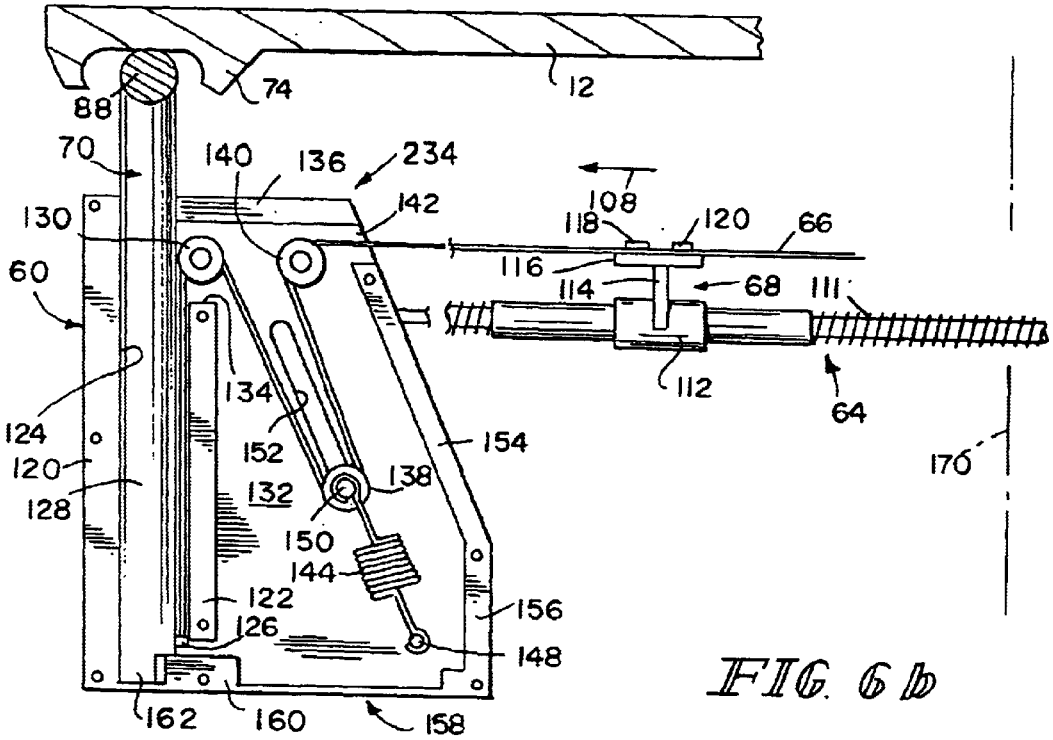
FIG. 6*b* corresponds to the situation shown in FIG. 6*a* and is a cross-sectional view of the lifting mechanism of FIG. 3 showing its spring in a lowermost position to tack up slack in the chain.
Figure 4B:
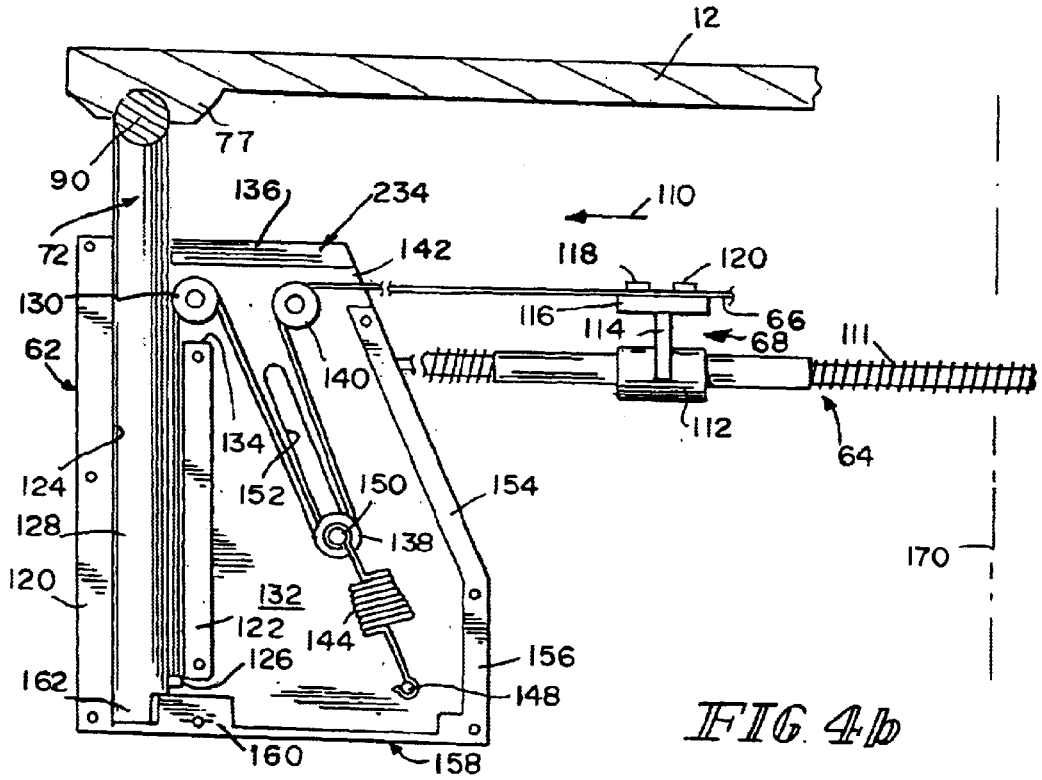
FIG. 4*b* corresponds to the situation shown in FIG. 4*a* and is a cross-sectional view of another lifting mechanism taken along the lines C—C of FIG. 7 showing its spring in a lowermost position to tack up slack in the chain.
Figure 5:
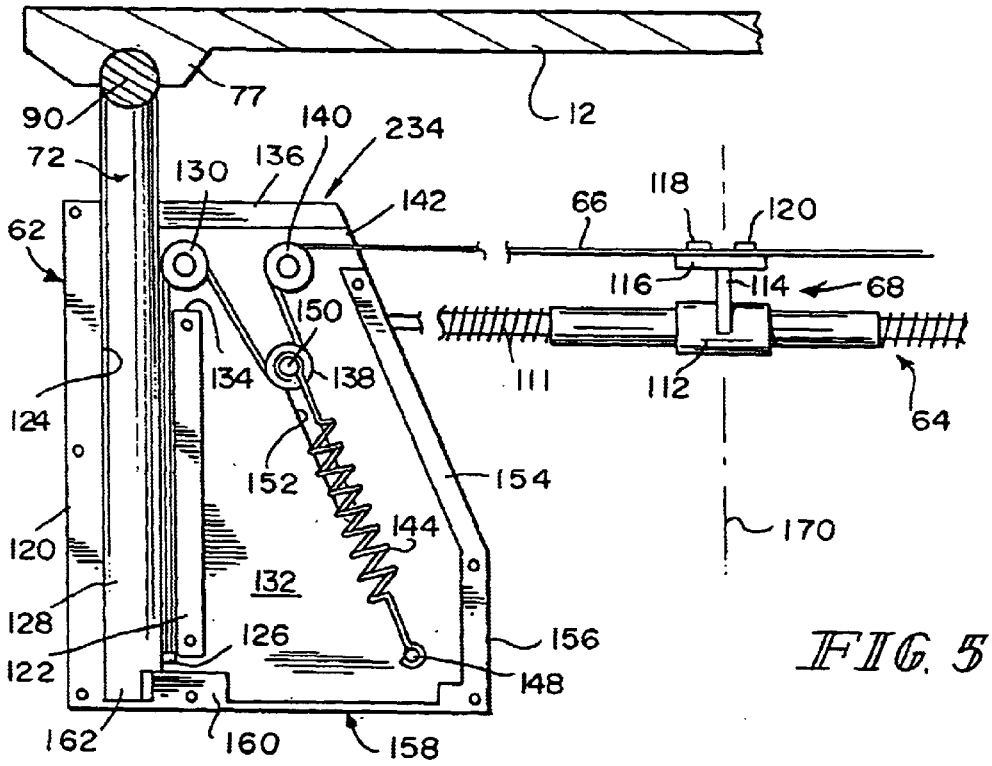
FIG. 5 corresponds to the situation shown in FIG. 3 and is a cross-sectional view of the lifting mechanism of FIG. 4*b* showing its lifting bar in the lowered position when the bracket is positioned at the mid-line.

A cross-sectional view of lifting mechanism housing 60 is shown in FIGS. 3 and 4 depicting lifting bar 70 in the lowered position. A cross-sectional view of lifting mechanism housing 62 is shown in FIGS. 5 and 6 depicting lifting bar 72 in the lowered position. Housings 60, 62 are similar to one another so that like reference numerals refer to like parts and the description of housing 60 applies also to the description of housing 62, except as otherwise noted.

Housing 60 comprises an end wall 120 and an opposed longitudinally extending, spaced-apart beam 122 defining a channel 124 through which bar 70 extends. A flange 126 extends from surface 128 of bar 70 which attaches to a portion of chain 66.

A first sprocket or bearing wheel 130 is positioned on wall 132 of housing 60 between the end 134 of beam 122 and top wall 136. Chain 66 engages sprocket or bearing wheel and extends around idler sprocket or idler pulley wheel 138 and a second sprocket or bearing wheel 140 near chain opening 142 where chain 66 exits housing 60. Sprocket or pulley wheel 138 is operatively coupled to spring 144 at end 146 which is attached to wall 132 at attachment 148. A pin 150 extends through sprocket or pulley wheel 138 and slot 152. (See also FIGS. 2 and 7.) The remainder of the casing of housing 60 includes angled wall 154 adjacent opening 142 and lower wall 156 all extending from wall 132. Base 158 includes a stepped portion 160 which engages notched portion 162 of bar 70 while in the lowered position, as shown in FIG. 3.

A first sprocket or bearing wheel 130 is positioned on wall 132 of housing 60 between the end 134 of beam 122 and top wall 136. Chain 66 engages sprocket or bearing wheel and extends around sprocket or pulley wheel 138 and a second sprocket or bearing wheel 140 near chain opening 142 where chain 66 exits housing 60. Sprocket or pulley wheel 138 is operatively coupled to spring 144 at end 146 which is attached to wall 132 at attachment 148. A pin 150 extends through sprocket or pulley wheel 138 and slot 152. (See also FIGS. 2 and 7.) The remainder of the casing of housing 60 includes angled wall 154 adjacent opening 142 and lower wall 156 all extending from wall 132. Base 158 includes a stepped portion 160 which engages notched portion 162 of bar 70 while in the lowered position, as shown in FIG. 3.

Housing 60 further includes covers 232 and 234, as illustrated, for example, in FIG. 7. Covers 232, 234 are coupled to one another along interface 151. Cover 232 is formed to include slot 152 and wall 132. Pin 150 extends through slots 152 which defines the slide path along which the sprocket or pulley wheel 138 moves.

Rounded head bars 88, 90 are longitudinally extending cylinders, as illustrated, for example, in FIG. 7. They mate with couplings 74, 77, as previously discussed.

Support surface 12 is level or horizontal in its lowered position when bracket 68 is positioned along a mid-line 170. When bracket 68 is positioned at mid-line 170, idlers 138 and pins 150 are positioned at their uppermost positions, thereby stretching springs 144, and support surface 12 is positioned in its horizontal lowered position, as illustrated, for example, in FIGS. 2, 3, and 5.

Bracket 68 moves longitudinally along drive screw 64 in either direction 108 or 110 upon rotation of drive screw 64. When bracket 68 is positioned between mid-line 170 and housing 62, lifting arm 70 is elevated while lifting arm 72 is positioned in its lowered position, as illustrated, for example, in FIGS. 4*a* and 4*b*. In this configuration, support surface 12 is tilted in one of the trendelenberg position and the reverse-trendelenberg position. Similarly, when bracket 68 is positioned between mid-line 170 and housing 60, lifting arm 72 is elevated while lifting arm 70 is positioned in its lowered position so that support surface 12 is tilted in the other of the trendelenberg position and the reverse-trendelenberg position, as illustrated, for example, in FIGS. 6*a* and 6*b*.

Chain 66 moves with bracket 68 to cause lifting arms 70, 72 to raise and lower. Movement of bracket 68 away from mid-line 170 toward housing 62 in direction 110 causes chain 66 to move past idlers 130, 138, 140 of housing 60 to pull upwardly on flange 126 of housing 60 and thereby raise lifting arm 70 to tilt support surface 12, as illustrated, for example, in FIG. 4*a*. At the same time, slack is produced in the portion of chain 66 positioned in housing 62. This slack allows spring 144 of housing 62 to pull idler 138 and pin 150 of housing 62 downwardly along slot 152 of housing 62 to take up the that slack, as illustrated, for example, in FIG. 4*b*. Lifting arm 70 is lowered by moving bracket 68 back toward mid-line 170 away from housing 62.

Figure 6A:
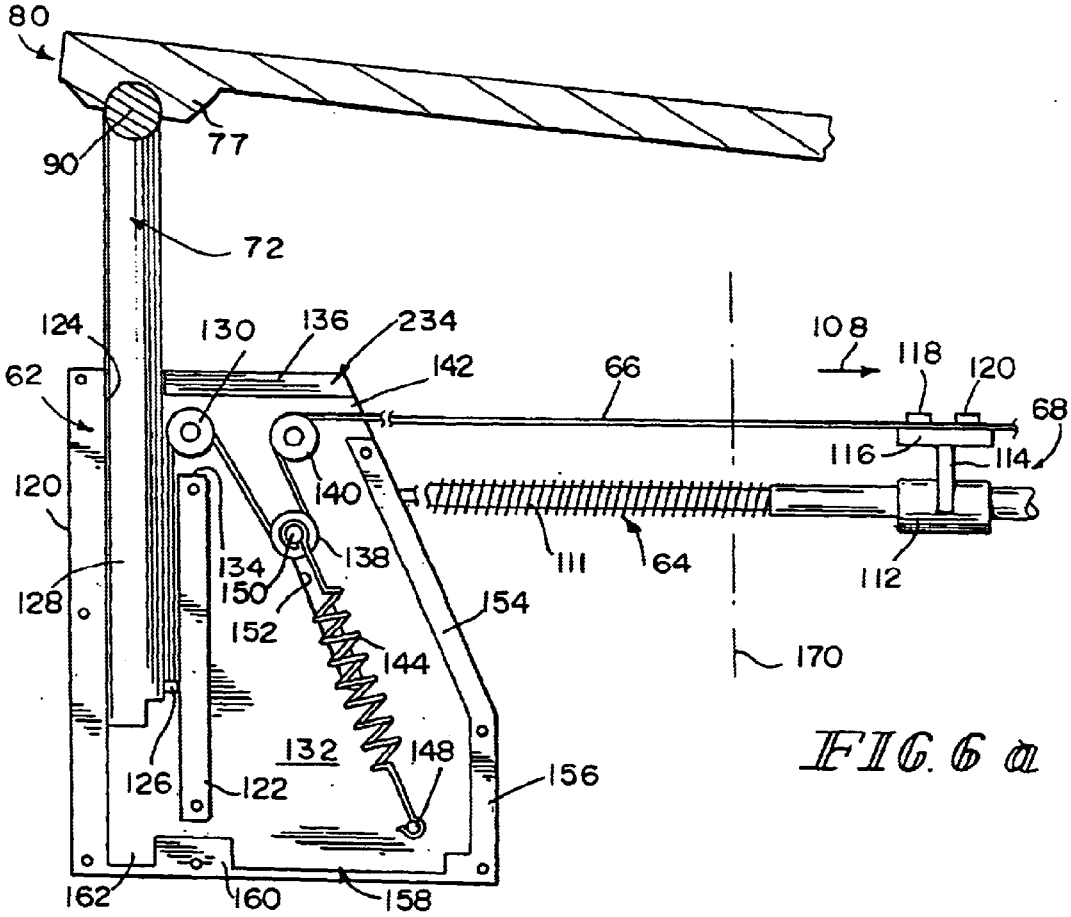
FIG. 6*a* is a cross-sectional view of the lifting mechanism of FIG. 5 showing its lifting bar in the raised position when the bracket is moved away from the lifting mechanism and the mid-line.

Similarly, movement of bracket 68 away from mid-line 170 toward housing 60 in direction 108 causes chain 66 to move past idlers 130, 138, 140 of housing 62 to pull upwardly on flange 126 of housing 62 and thereby raise lifting arm 72 to tilt support surface 12, as illustrated, for example, in FIG. 6*a*. At the same time, slack is produced in the portion of chain 66 positioned in housing 60. This slack allows spring 144 of housing 60 to pull idler 138 and pin 150 of housing 60 downwardly along slot 152 of housing 60 to take up that slack, as illustrated, for example, in FIG. 6*b*. Lifting arm 72 is lowered by moving bracket 68 back toward mid-line 170 away from housing 60.

An advantage of lifting apparatus 56 is that a single actuation means can be used to tilt support surface 12 in either direction 48 or 50, as illustrated, for example, in FIG. 2. Lifting apparatus 56 includes hand crank 46 which is rotatable in directions 98, 100, as illustrated, for example, in FIG. 7. A gear box 226 of actuator assembly 92 is operatively coupled to both crank 46 and drive shaft 64. Gear box 226 translates turning crank 64 in direction 98 or 100 into rotational movement of drive shaft 64 in direction 228 or 230 for movement of bracket 68 in direction 108 or 110.

Another embodiment of the lifting apparatus, indicated by reference numeral 250, is shown in FIGS. 8 through 12. Similar to the previous embodiment, lifting apparatus 250 includes a support surface 12, lifting mechanism housings 260, 262, and lifting bars 70, 72. Lift bars 70, 72 extend from lifting mechanism housings 260, 262, respectively, engaging couplings 74, 77, to lift support surface 12 in either direction 48 or 52, also similar to the previous embodiment. As depicted by hatched lines 78, 80, in FIG. 8, as either of the lift bars raise in directions 84 or 86, the support surface 12 and mattress 82 will be tilted in directions 48 or 52.

Figure 8:
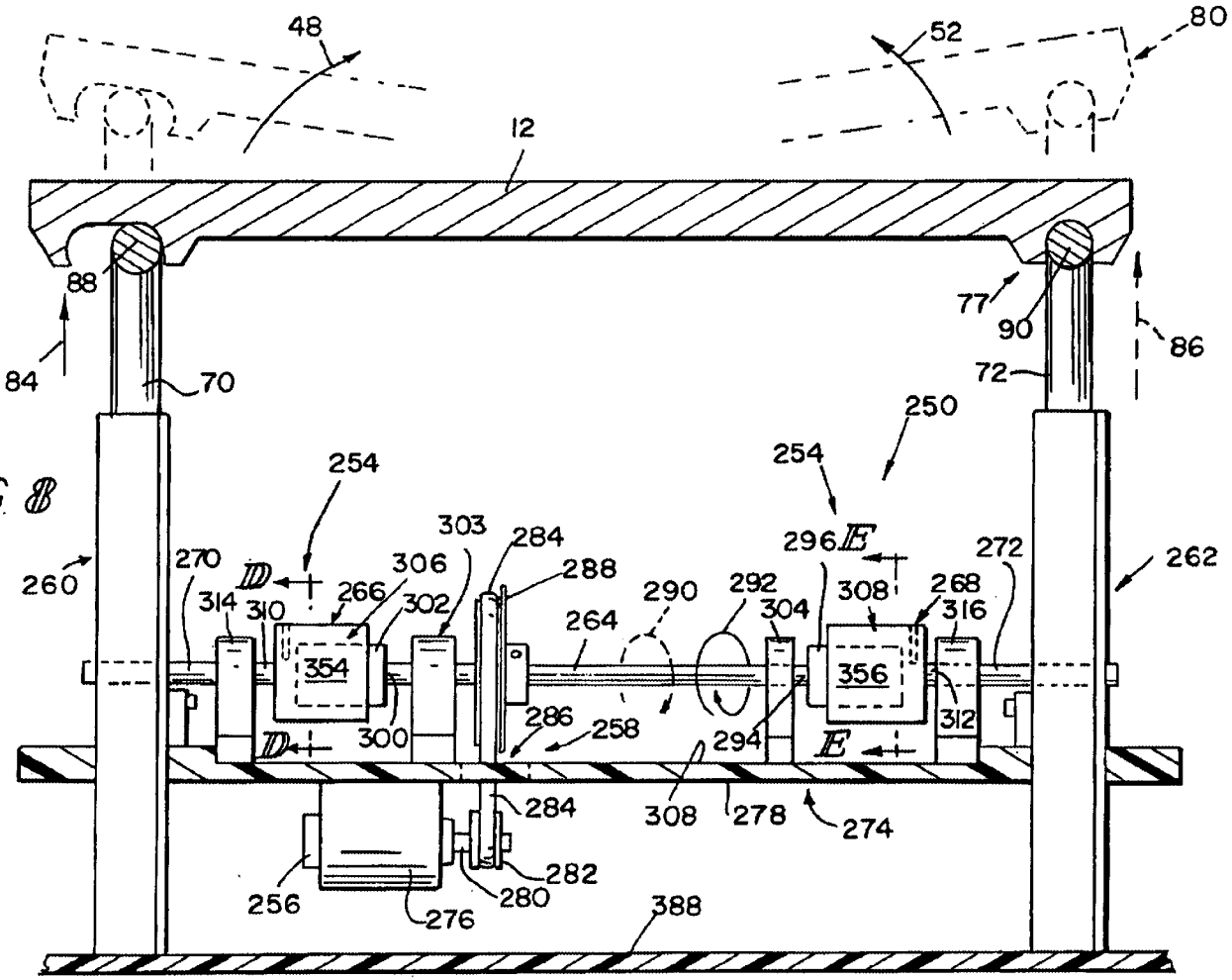
FIG. 8 is a side cross-sectional view of the patient support apparatus of FIG. 1 along the lines A—A of FIG. 1 showing another embodiment of the lifting apparatus.

As described in the previous embodiment, each lift bar 70, 72, includes a rounded head for bars 88, 90. (See also FIG. 9.) Bars 88, 90, engage couplings 74, 77, respectively. Coupling 74 is formed to include an elongated space to allow bar 88 to travel in the space when support surface 12 is raised or lowered as previously discussed. Opposite coupling 74, coupling 77 receives bar 90, also previously discussed in the apparatus 56. Coupling 77 is configured similar to a socket within which bar 90 pivots as support surface 12 moves upwardly 52, as depicted by broken lines 80. It is shown in FIG. 8 that as lift bar 72 moves upwardly, the increased length at which the support surface moves is compensated for by movement of bar 88 within coupling 74.

Figure 9:
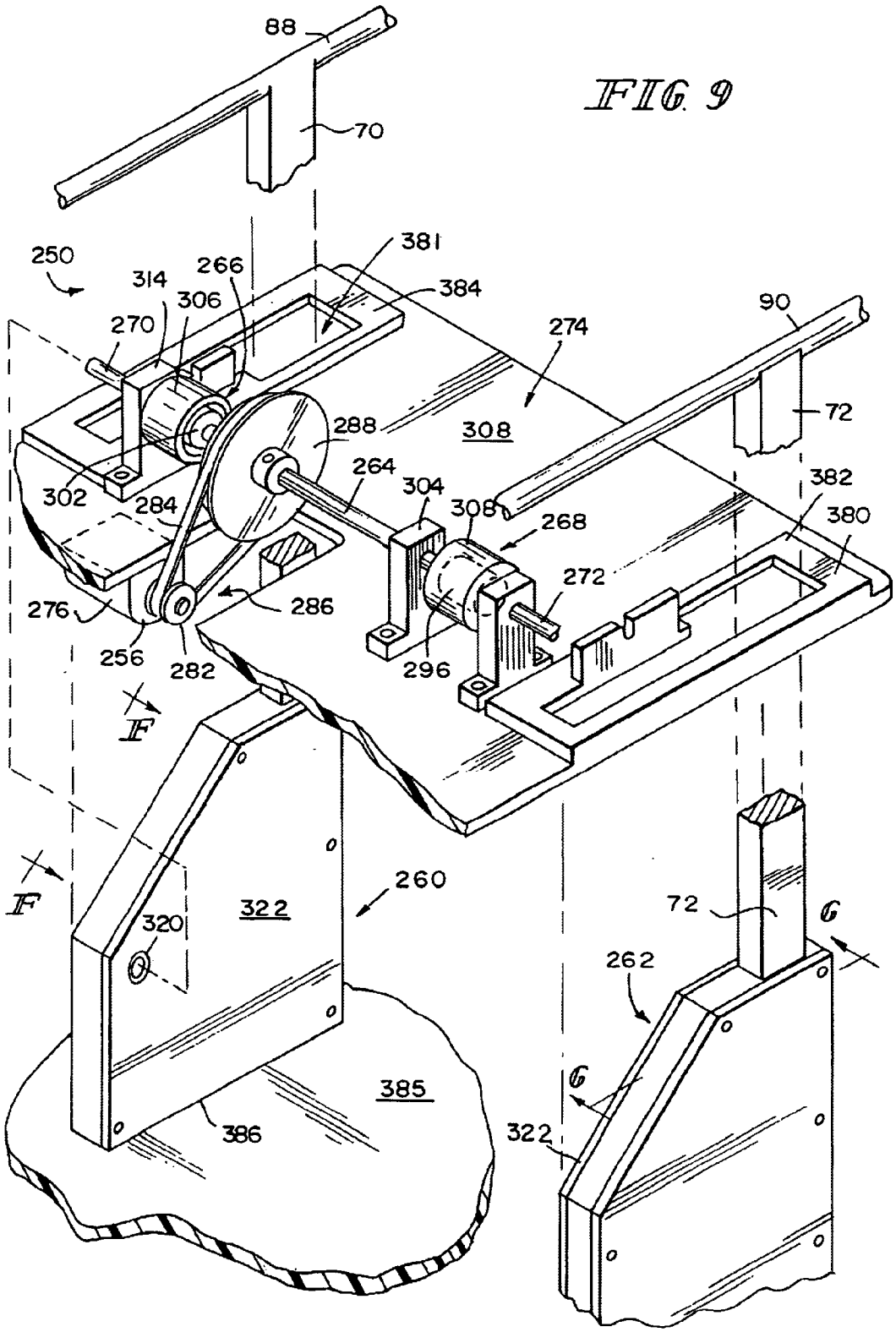
FIG. 9 is a perspective detail view of the lifting apparatus of FIG. 8.

Lifting apparatus 250 also comprises a loss-motion drive mechanism 254 that includes a motor 256, a belt drive system 258, a first drive shaft 264, first and second loss-motion drive plate assemblies 266, 268, and second and third drives shafts 270, 272. A base panel 274 is positioned between housing mechanisms 260, 262, to support the loss-motion drive mechanism 254. Motor 256 is a conventional bi-directional motor attached to bracket 276 which is attached to the lower surface 278 of panel 274. A drive shaft 280 extends from motor 256 and a first belt spool or wheel 282. A belt 284 is coupled to first belt spool or wheel 282 and extends through an opening 286 of base panel 274 coupling to a larger second belt spool or wheel 288, as shown in FIG. 9. Accordingly, as motor 256 rotates, first spool or wheel 282 is caused to rotate translating motion to second belt spool or wheel 288 through belt 284. First drive shaft 264 is caused to rotate in either direction 290, 292, depending on the rotation of motor 256. To support drive shaft 264 while it is rotating, it is disposed through support blocks 303, 304, that is appended to surface 308 of panel 274. The first end 294 of drive shaft 264 is coaxially attached to drive plate 296 of second loss-motion drive plate assembly 268. Second end 300 of drive shaft 264 is coaxially attached to drive plate 302 of the first loss-motion drive plate assembly 266. Each drive plate 302, 296 is engageable with a driven plate 306, 308 forming lost-motion assemblies 266, 268. Second and third drive shafts 270, 272 attach to driven plates 306, 308 at ends 310, 312, respectively. To support shafts 270, 272, they are disposed through support blocks 314, 316, that are appended to surface 308 of panel 274 in similar fashion to support blocks 303, 304, previously discussed.

Figure 10:
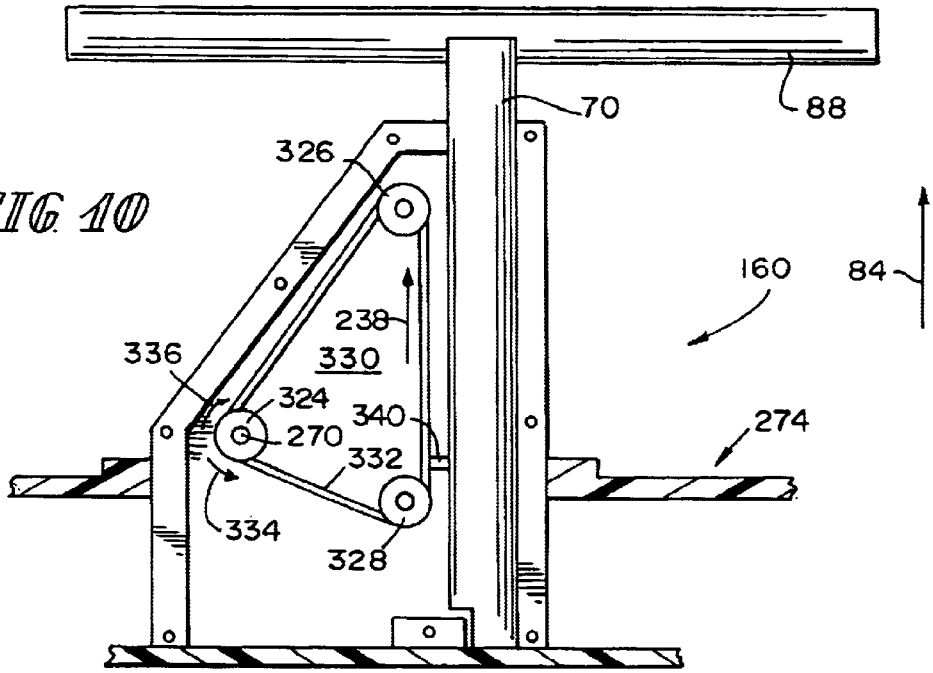
FIG. 10 is a cross-sectional view of one of the lifting mechanisms along the lines F—F of FIG. 9 with the lifting bar in the lowered position.
Figure 11:
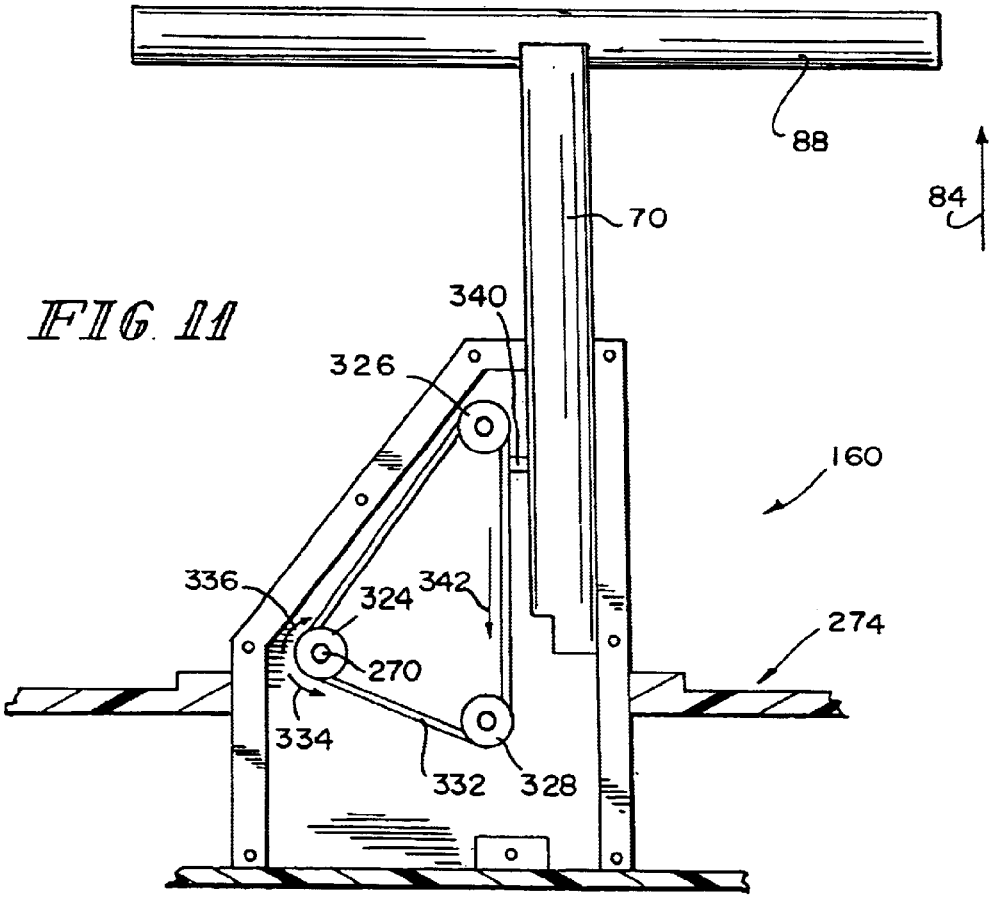
FIG. 11 is another cross-sectional view of the lifting mechanism along the lines F—F of FIG. 9 with the lifting bar in the raised position.
Figure 12:
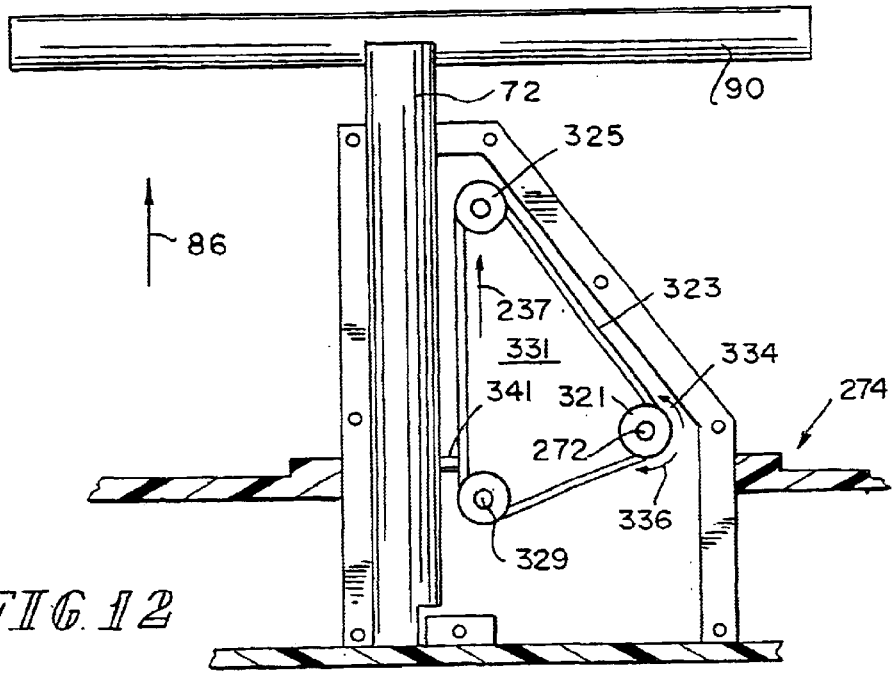
FIG. 12 is a cross-sectional view of another lifting mechanism along the lines G—G of FIG. 9 with the lifting bar in the lowered position.

Opposite ends 310, 312, of shafts 270, 272, extend in and are rotationally coupled to housing mechanisms 260, 262, respectively. As shown in FIGS. 10–13, housings 160, 162, comprise lifting bar 70, 72, that move between a lowered position, as shown in FIGS. 10 and 12, and a raised position shown in FIGS. 11 and 13. In the illustrated embodiment, second drive shaft 270 extends through aperture 320 of cover 322 operatively coupling to a first sprocket or wheel 324. Second drive shaft 270 serves as the axle for sprocket or wheel 324. (See FIG. 9.) Second and third sprockets or wheels 326, 328, are spaced apart and rotationally attached to wall 330. A belt or chain 332 encircles the three sprockets or wheels 324, 326, 328. Moving one of the sprockets or wheels will cause chain 332 to move. Accordingly, as drive shaft 270 causes sprocket or wheel 324 to move or rotate, chain 332 moves in the direction of rotation of sprocket or wheel 324, indicated by either reference numerals 334, 336. (See, for example, FIG. 10.)

A link 340 is attached to both chain 332 and lifting bar 70. As chain 332 moves in a direction 238, lifting bar 70 is caused to elevate in direction 84. Elevating bar 70 thereby causes support surface 12 to tilt to position 48, as depicted by hatched lines 78. (See FIG. 8.) Conversely, as chain 332 moves in direction 342, as shown in FIG. 11, bar 70 lowers in the direction opposite to direction 84.

Third drive shaft 272 extends through an aperture (not specifically shown) of cover 322 of mechanism housing 162 (not specifically shown). Shaft 272 is operatively coupled to a first sprocket or wheel 321. Shaft 272 serves as the axle for sprocket or wheel 321, as previously described with housing mechanism 260. (See FIGS. 12 and 13.) Second and third sprockets or wheels 325, 329 are spaced apart and rotationally attached to wall 331. A belt or chain 323 encircles the three sprockets or wheels 321, 325, 329. Moving one of the sprockets or wheels causes chain 323 to move. Accordingly, as drive shaft 272 causes sprocket or wheel 321 to rotate, chain 323 moves in the direction of rotation of sprocket or wheel 324, indicated by either reference numeral 334, 336.

Figure 13:
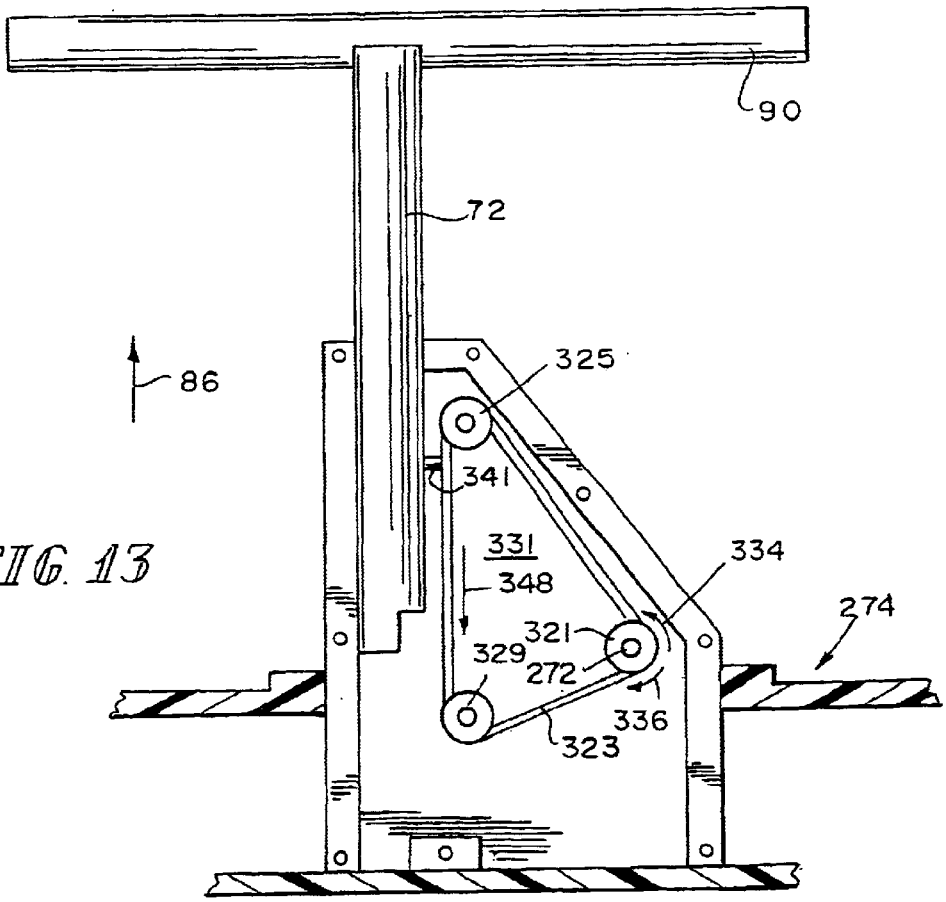
FIG. 13 is another cross-sectional view of the other lifting mechanism along the lines G—G of FIG. 9 with the lifting bar in the raised position.

A link 341 is attached to both chain 323 and lifting bar 72. As chain 323 moves in a direction 237, lifting bar 72 is caused to elevate in direction 86. Elevating bar 72 thereby causes support surface 12 to tilt to position 52, as depicted by hatched lines 80. (See FIG. 8.) Conversely, as chain 323 moves in direction 348, as shown in FIG. 13, bar 72 lowers in the direction opposite to direction 86.

Figure 14:
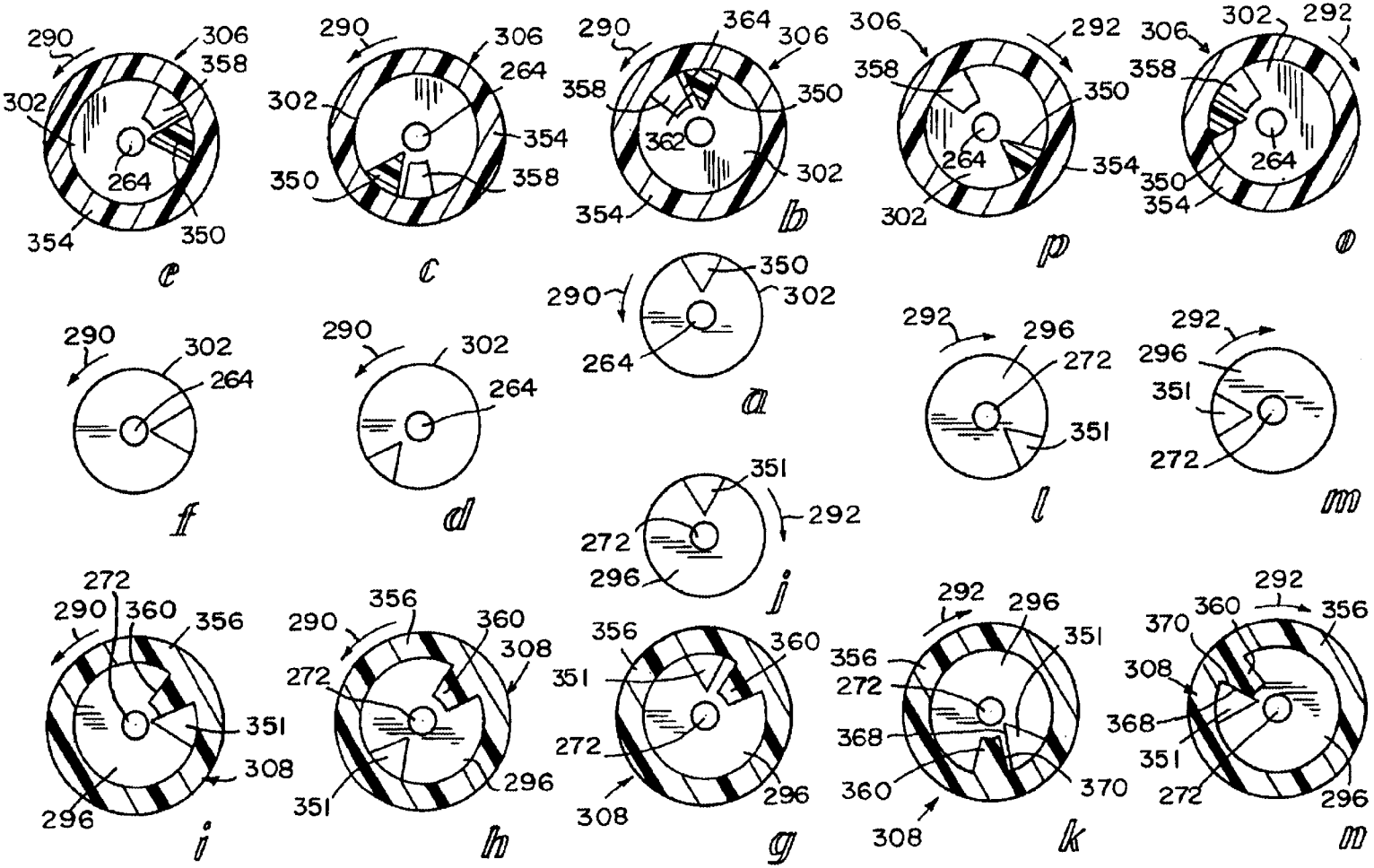
FIGS. 14*a* through 14*o* are several cross-sectional views of the drive and driven plates of the loss drive mechanism along the lines D—D or E—E of FIG. 8 showing their different positions relative to each other.

Lifting bars 70, 72, move by the selective motion of first and second loss-motion drive plate assemblies 266, 268. Depending on the direction motor 256 is moving, belt drive system 258 translates the rotation to drive shaft 264 rotating shaft 264 in either direction 290 or 292. As shaft 264 rotates, both drive plates 296, 302 rotate. As both drive plates rotate, however, only one will cause a lifting bar to move. The opposed lifting bar will either lower or remain stationary depending on its position relative to the other bar. Each drive plate 296, 302, is a cylindrical body having a tooth 350, 351, extending from an end 352, 353, respectively. (See FIGS. 9 and 14.) Each driven plate 306, 308, is a cup-like structure having an end 312, 314, with a cylindrical wall 354, 356 appended thereto, respectively. Each cylindrical wall 354, 356 is sized to receive one drive plate 296, 302, as shown in FIGS. 9 and 14. Each driven plate end 312, 314 also includes a tooth 358, 360 that cooperates with tooth 350, 351 of the drive plates, respectively, to move second and third drive shafts 270, 272.

The progressive cooperation between the two loss-motion drive plate assemblies 266, 268 is shown in FIG. 14. As previously discussed, the principal of the two loss motion plate assemblies is that as one drive plate moves in one direction, its corresponding driven plate is caused to move, thus, causing the drive shaft to move, thereby moving the chain, and ultimately causing lift bar to raise and tilt the end of the deck. Concurrently, the other drive plate moves as well, yet it does not cause its corresponding driven plate to move, thereby not causing its lift bar to raise. It is appreciated, however, that when the other driven plate moves in an opposite direction its lifting bar is caused to raise while the one drive plate, while it too moves, does not cause its lifting bar to raise. For example, in FIG. 14*a,* drive plate 302 is shown with tooth 350. When moved in direction 290, FIG. 14*b* shows the interaction between tooth 350 of drive plate 302 and tooth 358 of driven plate 306. As drive plate 302 rotates in direction 290, its first surface 362 engages the first surface 364 of tooth 358 of driven plate 306, causing driven plate 306 to rotate in direction 290, as shown in FIGS. 14*c* and 14*d.* Continued rotation of mechanism 306, as shown in FIGS. 14*e* and 14*f,* rotates drive shaft 270, which, as previously discussed, is extended through first sprocket or wheel 324, causing sprocket or wheel 324 to rotate. As shown in FIG. 10, the rotation of shaft 290 will cause sprocket or wheel 324 to rotate in direction 334, thereby moving chain in direction 338 and ultimately raising lifting bar 70 in direction 84.

As drive shaft 264 is rotating in direction 290, so too is drive plate 296. As shown in FIG. 14*g,* teeth 351 and 360 do not engage to cause third drive shaft 272 to raise lifting bar 72. Rather, lifting bar 72 either remains at rest or lowers while lifting bar 70 raises in direction 84. Support surface 12 will thereby be moved to a tilted position 48. In the illustrated embodiment, as drive plate 296 continues to move in direction 290, as shown in FIG. 14*h,* tooth 360 may contact tooth 351, as shown in FIG. 14*i,* but that contact, will not cause lifting bar 72 to raise. Contrarily, the movement causes a slow rate of descent of bar 72.

As drive shaft 264 rotates in opposite direction 292, so too do both drive plates 296, 302. As shown in FIG. 14*j,* drive plate 296 is shown with tooth 351. When moved in direction 292, FIG. 14*k* shows the engagement between tooth 351 of plate 296 and tooth 360 of driven plate 308. As drive plate 296 rotates in direction 292, its first surface 368 engages the first surface 370 of tooth 360 of driven plate 308, causing driven plate 308 to rotate in direction 292. (See FIGS. 14*k* and *n*.) Continued rotation of mechanism 268 rotates drive shaft 272 which, as previously discussed, is extended through first sprocket or wheel 321, causing sprocket or wheel 321 to rotate. As shown in FIG. 12, the rotation of shaft 272 causes sprocket or wheel 321 to rotate in direction 336, thereby moving chain in direction 237 and ultimately raise lifting bar 72 in direction 86.

As shown in FIGS. 14*o* and *p,* teeth 350 and 358 do not engage each other as drive shaft 264 rotates in direction 292 to raise bar 70. Lifting bar 70 either remains at rest or lowers while lifting bar 72 raises in direction 86. Support surface 12 will thereby be positioned in a tilted position 52. In the illustrated embodiment, as drive plate 296 continues to move in direction 292, as shown in FIG. 14*n,* tooth 350 of plate 302 may contact tooth 358 of plate 306, as shown in FIGS. 14*p* and 14*o,* but that contact will not cause lifting bar 70 to raise. Contrarily, the movement causes a slowing of the rate of descent of bar 70, if surface 12 is previously in the tilted position 48, or maintains bar 70 in the lowered position.

Accordingly, as motor 256 rotates in one direction, one end of support surface 12 will rise. As one loss-motion assembly causes one side to rise the other loss-motion assembly will allow the opposite side of support surface 12 to descend or remain in the lowered position.

As shown in FIG. 9, panel 274 includes 2 openings 380, 381, through which housing mechanisms extend. Reinforcing brackets 382, 384 surround the periphery of 380, 381 to secure housing mechanisms to base panel 274. In the illustrated embodiment, bottom 386 of housing mechanism 260 is attached to a sub flooring 388, providing rigidity to apparatus 254.

It is appreciated that any bidirectional motor can be used to rotate shaft 264. It is contemplated that a caregiver, by the use of a single hand motion, actuates the motor (see e.g., motor 256) to cause surface 12 to move to tilted position 48. It is further contemplated that it will require the caregiver only a second hand action to actuate the motor to move surface 12 to either a level position or tilted position 80.

Figure 15:
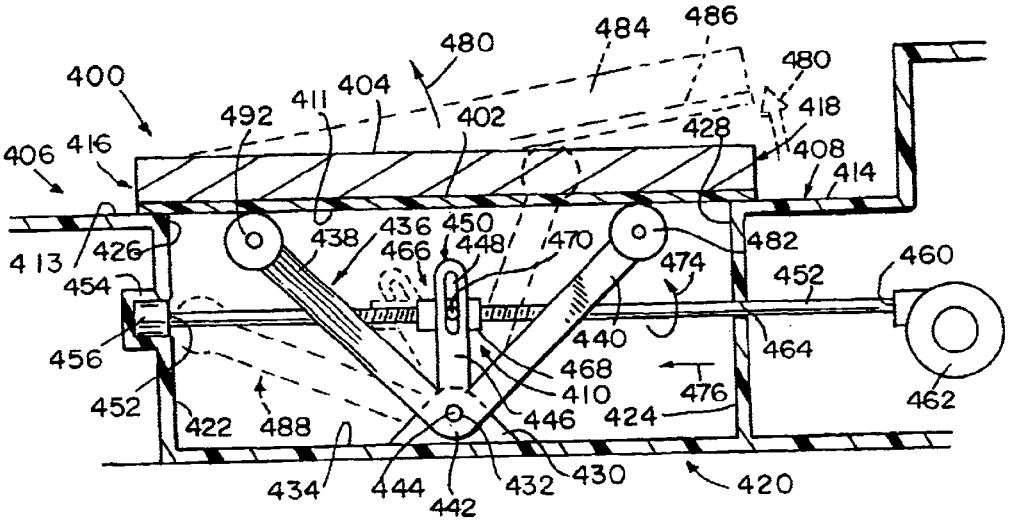
FIG. 15 is a side cross-sectional view of the patient support apparatus of FIG. 1 along the lines A—A of FIG. 1 showing still another embodiment of the lifting apparatus.
Figure 16:
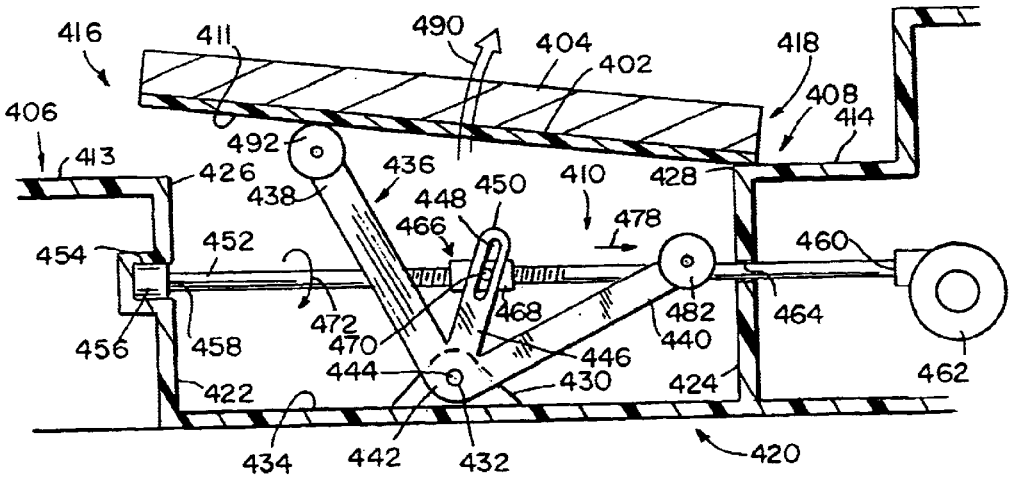
FIG. 16 is another side cross-sectional view of the patient support apparatus of FIG. 1 along the lines A—A of FIG. 1 showing the lifting apparatus of FIG. 15 with the support surface in a tilted position.

A still further embodiment of the lifting apparatus, indicated by reference numeral 400, is shown in FIGS. 15 and 16. Lifting apparatus 400 includes a support surface 402 upon which a mattress 404 rests, and a pair of support walls 406, 408, defining a cavity 410 within which lifting mechanism 412 is positioned. Support surface 402 is a panel with an underside 411 that is longitudinally extending over a portion of both lateral surfaces 413, 414. Accordingly, when support surface 402 is lowered in a non-tilted position, underside 411 rests upon both surfaces 413, 414, at head and foot ends 416, 418, respectively.

Cavity 410 is defined by a base 420 and upwardly extending walls 422, 424. Surfaces 413, 414 extend laterally from the uppermost extent of walls 422, 424 at corners 426, 428, respectively. Within cavity 410 is positioned lifting mechanism 412. A triangularly shaped pivot bracket 430 having a pivot aperture 432 is attached to surface 434 of base 420. Pivotally attached to bracket 430 is a lifting-arm assembly 436.

Lifting-arm assembly 436 comprises perpendicularly oriented first and second arms 438, 440. The vertex 442 of the arms 438, 440 includes a pin 444 disposed therethrough and through bracket 430, thus, allowing arms 438, 440 to pivot bracket 430. A center arm 446 is coupled to vertex 442. Arm 446 includes a slot 448 longitudinally extending from uppermost portion 450. A threaded drive shaft 452 extends from wall 422 to wall 424. A pocket 454 is disposed within wall 422. Pocket 454 is sized to receive a bearing surface 456, through which first end 458 of drive shaft 452 extends and within which drive shaft 452 rotates. Opposite first end 458, second end 460 is coupled to a bi-directional actuator 462. Drive shaft 452 extends through an aperture 464 allowing rotation within aperture 464.

A bracket 466 having threaded mount portion 468 and a laterally extending pin 470 is disposed on drive shaft 452. As actuator 462 causes drive shaft 452 to rotate in either direction 472, 474, threaded mount portion 468 moves longitudinally along shaft 452 in directions 476, 478. (Compare FIGS. 15, and 16.) Pin 470 extends through slot 448. As shown in FIG. 15, when shaft 452 is rotated in direction 474, bracket 466 moves in direction 476. This movement causes lifting arm assembly 436 to pivot about pin 444 in direction 480. A hub or wheel 482 is rotatably attached to arm 440 at its uppermost extent. As arm 440 continues to pivot in direction 480, the engagement between underside 411 of surface 402 and wheel 482 causes surface to lift as depicted by hatched lines of mattress 484, surface 486 and lifting arm assembly 488. It is shown in FIG. 15 that movement of bracket 466 in direction 476 moves pin 470 and, thus, center arm 446 in the same direction to cause this effect.

Conversely, as depicted in FIG. 16, as shaft 452 is rotated in direction 472, bracket 466 is caused to move in direction 478 which, in turn, causes pin 470 and center arm 466 to move in direction 478. The movement of center arm 446 causes assembly 436 to pivot in direction 490. A hub or wheel 492 is rotatably attached to arm 438 at its uppermost extent, similar to wheel 482, previously discussed. As arm 438 continues to pivot in direction 490, the engagement between underside 411 of surface 402 and wheel 492 causes surface 402 to lift, as depicted in FIG. 16.

It is contemplated that the movement between the tilted positions is accomplished by a switch (not shown) in contact with actuator 462. In operation, the caregiver using a single motion or action can activate the switch once to move surface 402 to a tilted position, and then a second action to move surface 402 back to a level position or the reverse tilted position. These two motions or actions simplify the caregiver's task of moving the surface. In addition, it is further contemplated that the switch can be replaced by a single hand crank (not shown) that can be used to move surface 402 between the tilted, level, and reverse tilted positions.

Figure 17:
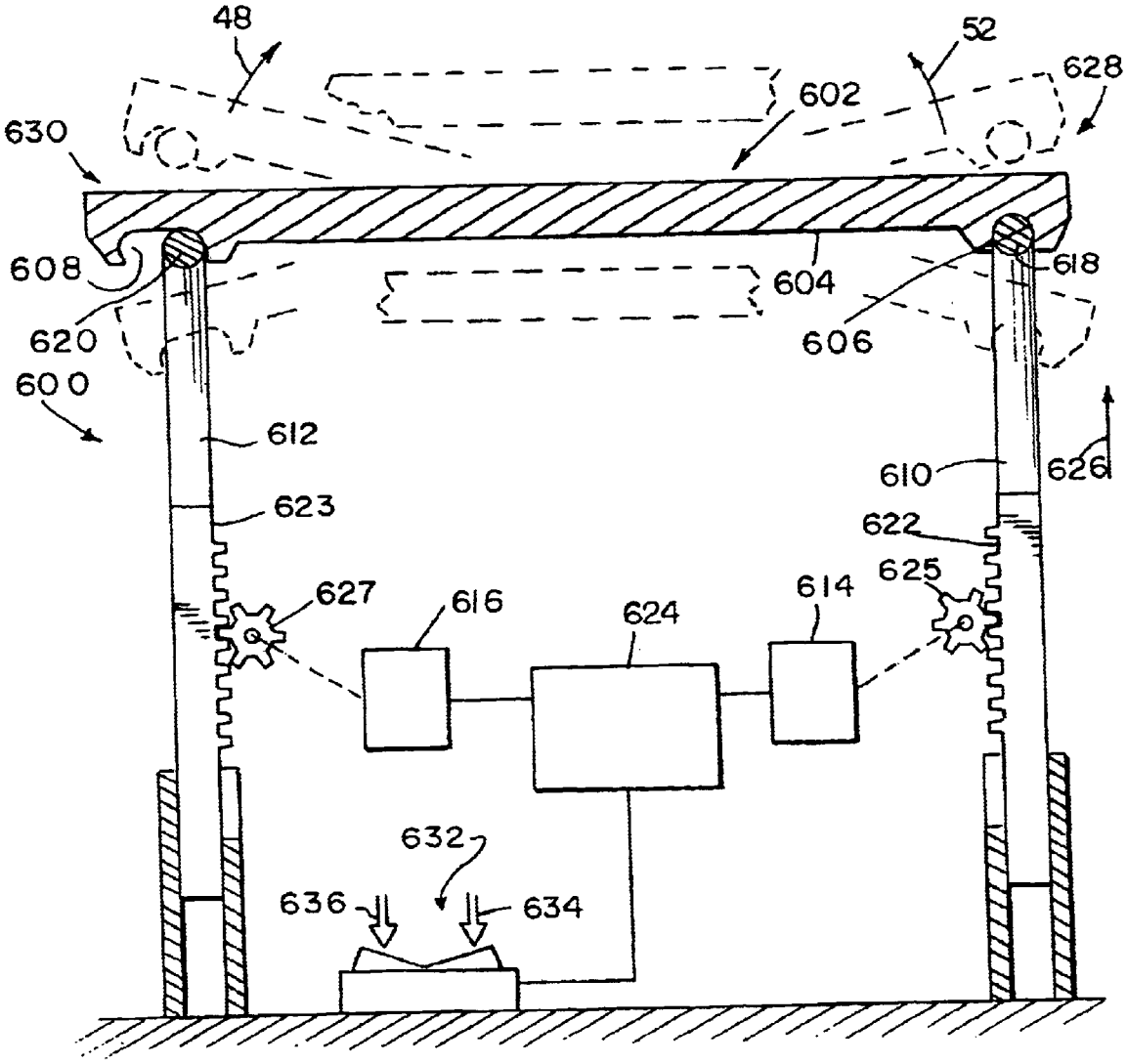
FIG. 17 is a side view of yet another embodiment of the lifting apparatus.

A yet further embodiment of the lifting apparatus, indicated by reference numeral 600 is shown in FIG. 17. It is contemplated that apparatus 600 is configured to be usable in any of the cavities or below any of the support surfaces described in any of the previous embodiments. Apparatus 600 includes a support surface 602 having an underside 604 with couplings 606, 608 similar to couplings 74, 77 shown in FIGS. 2 and 8, previously described. Elevators 610 and 612 extend upwardly and engage couplings 606, 608 at heads 618, 620. It is contemplated that the elevators 610, 612 can be attached to racks 622, 623 with corresponding gears 625, 627, as shown in FIG. 17.

In the illustrated embodiment, stepper motors 614, 616 are of conventional types that, in response to a signal sent from a controller 624, move in one direction one unit. For example, controller 624 sending a signal to stepper motor 614 moves elevator 610 upwardly one unit in direction 626 thereby tilting end 628 of surface 602. Conversely, a signal can be sent to motor 616 to cause elevator 612 to move upward one unit in direction 626 thereby lifting end 630. It is appreciated that controller 624 can be configured such that, as a signal is sent to raise one of the stepper motors 614, 616, another signal is sent to lower the other stepper motor.

A double-throw switch 632 in contact with controller 624 allows a user to determine the desired position of surface 602. For example, if the user presses first portion 634 of switch 632, controller 624 will send a signal to stepper motor 614 raising elevator 610 thereby raising and tilting surface 602. It is appreciated that switch 632 and controller 624 can be configured such that elevator 610 will raise with a single press-and-release of portion 634. Conversely, switch 632 and controller 624 can be configured such that elevator 610 will raise as portion 634 is pressed-and-held. This type of switch will allow the caregiver to hold portion 634 until surface 602 is raised to a desired level. Releasing portion 634 will stop elevator 610 at that level.

In similar fashion, if the user presses second portion 636 of the switch 632, controller 624 will send a signal to stepper motor 616 raising elevator 612 thereby raising and tilting surface 602. It is appreciated that controller 624 can be configured such that as either end 628 or 630 raises, the opposite end will lower if previously in the raised position. It is further appreciated that switch 632 and controller 624 can be configured such that elevator 612 will raise with a single press-and-release of portion 634. Conversely, switch 632 and controller 624 can be configured such that elevator 612 will raise as portion 634 is pressed-and-held. This type of switch will allow the caregiver to hold portion 636 until surface 602 is raised to a desired level. Releasing portion 636 will stop elevator 612 at that level.

FIG. 17 shows surface 602 can be raised or lowered from its solid line horizontal position to a raised horizontal (broken line) position or a lowered horizontal (broken line) position. The controller 624 and switch 632 can be configured and operated to raise or lower the surface 602 as well as to tilt the surface 602 between trendelenberg and reverse trendelenberg positions.

Although the present application has been described with reference to particular means, materials and embodiments, from the foregoing description, one skilled in the art can easily ascertain the essential characteristics of the present application and various changes and modifications may be made to adapt the various uses and characteristics without departing from the spirit and scope of the present application, as described by the claims which follow.

What is claimed is:

1. An infant support for an incubator or a warmer or a combination thereof, the support comprising:

a base;

a patient support supported above the base for vertical movement relative to the base between an elevated position and a lowered position;

a support surface supported above the patient support for receiving an infant, the support surface having a head end and a foot end;

an elevator coupled to each end of the support surface to raise and lower each end relative to the patient support; and a drive associated with the elevators, the drive comprising a motor coupled to each elevator, and a control for the motors, whereby either end of the support surface may be moved between raised and lowered positions relative to the patient support to position the patient support surface in trendelenberg and reverse trendelenberg positions.

2. The support of claim 1, wherein the control comprises a switch operable with a hand to move the support surface between raised and lowered positions.

3. The support of claim 1, wherein each elevator comprises a rack and the drive comprises a gear coupling each motor to the rack of its associated elevator.

4. An infant support for an incubator or a warmer or a combination thereof, the support comprising:

a base, a patient support supported above the base for vertical movement relative to the base between an elevated position and a lowered position, a support surface supported above the patient support and having a head end and a foot end, an elevator associated with each of the head end and the foot end, a drive motor coupled to each elevator, and a controller coupled to the drive motors, the controller being configured to drive either or both drive motors to raise or lower the support surface relative to the patient support or to tilt the support surface relative to the patient support between trendelenberg and reverse-trendelenberg positions.

5. The support of claim 4, wherein each drive motor is a stepper motor.

6. The support of claim 4, further comprising a switch coupled to the controller to raise or lower the support surface or to tilt the support surface between trendelenberg and reverse-trendelenberg positions.

7. The support surface of claim 4, wherein each drive motor is coupled to its associated elevator by a rack and pinion gear.

8. The support surface of claim 7, wherein each drive motor is coupled to one of the gears.

9. An infant support for use with an incubator or a warmer, the support comprising:

a base, a patient support supported above the base for vertical movement relative to the base between an elevated position and a lowered position, a support surface supported above the patient support and having a head end and a foot end, and a driver engageable with the head and foot ends, the driver comprising a first elevator, a second elevator and at least one motor, the first elevator being engageable with the head end, and the second elevator being engageable with the foot end, wherein the driver is operable to cause the head and foot ends to move between raised and lowered positions relative to the patient support to position the patient support surface in trendelenberg and reverse trendelenberg positions.

10. The support of claim 9, wherein the driver is a reciprocating driver that is movable in first and second directions.

11. The support of claim 10, wherein the head end moves between raised and lowered positions when the driver moves in the first direction.

12. The support of claim 9, wherein the foot end moves between raised and lowered positions when the driver moves in the second direction.

13. The support of claim 12, wherein, as the driver moves in the first direction, the head end moves to the raised position, and, when the driver moves in the second direction, the foot end moves to the raised position.

14. The support of claim 13, wherein, as the driver moves in the second direction, the head end of the surface moves to the lowered position, and, when the driver moves in the first direction, the foot end of the surface moves to the lowered position.

15. An incubator or warmer comprising:

a base;

a patient support supported above the base for vertical movement relative to the base between an elevated position and a lowered position;

a support surface supported above the patient support;

means for engaging the support surface; and a switch for operating the support surface engaging means to move the support surface between trendelenberg and reverse-trendelenberg positions relative to the patient support.

16. An infant support for an incubator or a warmer, the infant support comprising:

a base, a patient support supported above the base for vertical movement relative to the base between an elevated position and a lowered position, a support surface supported above the patient support for receiving an infant, the support surface being large enough to support an infant but not large enough to support an adult, the support surface having a head end and a foot end, a head end elevator and a foot end elevator, each elevator being mounted for movement upwardly or downwardly, the head end elevator being coupled to the head end of the support surface, and the foot end elevator being coupled to the foot end of the support surface, a driver, a controller for the driver, a selector switch for operating the controller, and the elevators being operatively connected to the driver such that either elevator can be raised and lowered by the driver without raising or lowering the other elevator to tilt the support surface relative to the patient support between a trendelenberg position and a reverse trendelenberg position, and such that both elevators can be simultaneously raised and simultaneously lowered to move the support surface relative to the patient support between an elevated position and a lowered position.

17. An infant support for an incubator or warmer, the infant support comprising:

a base, a patient support supported above the base for vertical movement relative to the base between an elevated position and a lowered position, a support surface supported above the patient support for movement relative to the patient support between a trendelenberg position and a reverse trendelenberg position, a drive assembly operably coupled to the support surface and configured to tilt the support surface relative to the patient support between the trendelenberg and reverse trendelenberg positions, the drive assembly comprising at least one motor and a mechanism coupling the motor to the support surface, and a controller selectively operable to actuate the drive assembly.

* * * * *